US005566396A

United States Patent [19]

Leib

[11] Patent Number: 5,566,396

[45] Date of Patent: Oct. 22, 1996

[54] STOCKING CONSTRUCTION USING TAPERED FLAT BED KNIT LEG

[76] Inventor: Deborah A. Leib, 75 Birch Dr., Roslyn, N.Y. 11576

[21] Appl. No.: 484,017

[22] Filed: Jun. 7, 1995

[51] Int. Cl.[6] ..... A41B 11/00; A43B 17/00

[52] U.S. Cl. ..... 2/239; 2/240

[58] Field of Search ..... 66/178 R, 171, 66/183; 2/239, 240, 241, 242

[56] References Cited

U.S. PATENT DOCUMENTS

| | | | |
|---|---|---|---|
| 1,644,185 | 10/1927 | Fischer | 2/240 |
| 1,743,998 | 1/1930 | Dinkelspiel | 2/239 |

FOREIGN PATENT DOCUMENTS

| | | | |
|---|---|---|---|
| 525223 | 9/1921 | France | 2/239 |
| 830421 | 7/1938 | France | 2/240 |
| 1429440 | 1/1966 | France | 2/239 |
| 1442874 | 5/1966 | France | 2/239 |
| 182355 | 3/1907 | Germany | 2/239 |
| 7710 | 5/1889 | United Kingdom | 2/239 |
| 227398 | 1/1925 | United Kingdom | 2/240 |

*Primary Examiner*—John J. Calvert
*Attorney, Agent, or Firm*—Mark J. Egyed

[57] ABSTRACT

Knitted stocking construction comprising a circular knit tubular foot portion and a tapered flat bed knit lower leg portion. Use of a flat knit lower leg portion allows pattern differentiation when yarn type and color, needle patterns, and stitch types are varied. Flat bed knitting of the lower leg portion also allows a substantial genuine width taper. The tapered flat bed knit lower leg portion 36 may be constructed using weft or warp knits, and may be equipped with drawstrings or other features like pockets.

9 Claims, 1 Drawing Sheet

STOCKING CONSTRUCTION USING TAPERED FLAT BED KNIT LEG

BACKGROUND OF THE INVENTION

This invention relates to knitted fabrics, and more particularly, to a novel construction for knitted stockings.

There are two main knitting processes used to make knitted fabrics: tubular or circular forms, which usually employ filling or weft knits; and flat forms, which usually use warp knits. Seamless hosiery is produced by circular knitting machines, as is known in the art. In making seamless hosiery, knitting in a tubular or circular form is the method of choice for socks and stockings because there is no seam requirement inherent in circular knitting, and the method gives high speed, economy of manufacture and high quality. The circular knitting method also allows for use of a wide variety of needle gauges and spacings, from coarse ("heavy" or "athletic" type) gauges to very fine gauges used in fine hosiery such as women's stockings.

Most modern circular hosiery machines use 3½ or 4 inch diameter needle cylinders. They employ double hooked latch needles that work directly opposite one another in substantially the same plane to knit [1] the leg portion; [2] the main foot portion; [3] the heel; [4] the toe. Heels and toes are often left open and later closed in a separate step. Usually the seam establishing the toe box is positioned above the toes, but a Getaz toe may be used instead, providing a seam under the toes, as is known in the art. The number of needles used in the needle cylinders may vary. Heavyweight coarse socks may be knitted using 80–120 needles per cylinder, often with terry loops or other techniques used to provide cushioning in the sole of the foot. Medium weight "dress" socks may use 120–240 needles, often with a rib-knit construction to improve comfort and moisture wicking. Sheer stockings and related products like panty hose use very fine needles, as high as 400 for a 3 ½ inch diameter needle cylinder.

In flat bed knitting machines, needles are either mounted on a flat plate or needle bed or in two beds that are at right angles to one another, and typically each at a 45° angle with respect to the horizontal. The fabric to be knitted passes down through the space between the plates where cam operated needles knit in synchrony With the actions of yarn guides, as is known in the art. The width of the resultant fabric can be easily varied by changing the number of active needles. This allows not only tapering but also shaping of fabrics, which when sewn together make a complete garment. An almost unlimited variety of designs is possible by changing yarn color, stitch type, cam profiles, and Jacquard devices. Cotton frames on these machines allow for automatic narrowing and widening devices.

Recently, new leisure and sport sock designs have combined two elements: light or fine needle foot portions for comfort (e.g., thin silk, cotton or nylon), with heavy knit coarse lower leg portions to provide warmth, ankle/lower leg protection and a stylish appearance. In these new designs, a heavy circular knit lower leg portion is sewn or joined with a thin or fine circular knit foot portion. Some of these new designs use drawstrings, pockets and other value added features to enhance their stylishness and utility for a number of situations, from snow skiing and mountain climbing to lower leg leisure wear.

Although these new designs have become very popular and have started a new paradigm in the leisure sock industry, limitations inherent to circular knitting processes used in hosiery make it difficult go further to satisfy recent consumer tastes and desires:

[1] Up to now, it has been very difficult and expensive or virtually impossible to vary the diameter of a circular knit article, so the foot portion and leg portion are respectively confined to a set diameter along their respective lengths. In short, it is not possible without undue expense and extra processing steps to vary the diameter of the lower leg portion to create a tapered lower leg. Tapered lower legs are desirable from a style standpoint and offer physical advantages as well. A tapered lower leg allows a self supporting stance for a heavy knit material, reducing the need for a elastic material or a biased elastic design that socks typically use to keep the sock from falling down. Not having the elasticity improves circulation and eliminates the problem of generating marks and depressions on the flesh of the wearer. This self supporting stance can be aided by having the lower part of the lower leg portion rest on the wearer's shoe. A tapered lower leg design also allows for insertion of pant or pantyhose legs into the sock without difficulty. Moreover, a tapered lower leg offers an attractive "draped" appearance not found in circular knit articles.

[2] It has also been difficult or impossible to provide for complex patterns for the lower leg. Consumers have expressed interest in having pattern differentiation where different yarns, needle patterns, colors, or even fabric heights are used in the lower leg portion.

Circular knitting machines are not capable of providing for both substantially tapered width sock bodies and performing complex knitting steps and yarn changes required for beautiful complex lower leg patterns. As a result, products in this market segment are attractive but cannot be substantially tapered and have complex Jacquard style patterning. Even double cylinder Jacquard Link machines used in the Orient have similar limitations in that, barring expensive additional steps, they can only produce traditional sock sizing, with no substantial taper of the sock body. They are also often limited to finer gauge yarns.

One stocking shown in the prior art is U.S. Pat. No. 5,035,008 to Schneider. This leisure wear stocking shows a lower leg portion of heavy cotton circular knit material sewn or joined to a thin silk material with a reinforced toe or heel used for a foot portion. While this alleviates the problems associated with uniform thick Socks like bunching and excessive perspiration of the foot, Schneider does not provide for a substantially tapered lower leg whose advantages are cited above, and is subject to the limitations of circular knitting machines as cited above.

U.S. Pat. No. 560,831 to Barroll shows an example of the early legging art where the leg portion terminates in a strap structure that the wearer steps into. The lower leg portion used for the legging is the result of a circular knitting process and lacks substantial taper and is similarly subject to limitations of circular knitting machines.

U.S. Pat. No. 1,708,342 to J. H. Vogt shows a stocking that combines circular knitting methods for the "tubular" lower leg and foot portions of the sock with straight or flat knitting methods used for the foot bottom, heel and toe. It also does not provide taper or design freedom for the lower leg portion as is contemplated above.

Similarly, U.S. Pat. No. 2,125,451 to Kolliner shows a "breechette" with no foot structure. All components are tubular or circular knit and no taper is provided.

It is therefore one object of this invention to provide for a tapered lower leg sock portion that can be combined with the advantages of using light or fine circular knit fabrics for the foot portion.

It is another object of this invention to provide a lower leg portion knitting process that satisfies the requirements of a tapered lower leg portion and allows full use of complex multi-differentiated patterning as well.

SUMMARY OF THE INVENTION

According to the present invention, there is disclosed a knitted stocking construction comprising a circular knit tubular foot portion and a tapered flat bed knit lower leg portion. The use of a flat bed knit lower leg portion allows almost unlimited pattern differentiation when yarn type and color, needle patterns, and stitch types are varied. The flat bed knitting process also allows a substantial genuine taper to the lower leg portion. The tapered flat bed knit lower leg portion 36 may be constructed using weft or warp knits.

In the contemplated invention, it is anticipated that conventional heel and toe closures, flat bed or circular knit cuffs, and conventional linings and fold overs may be added. In another embodiment, one or more drawstrings may be added to the body of the tapered flat bed knit lower leg portion.

SCHEDULE OF REFERENCE CHARACTERS

Figure 1:
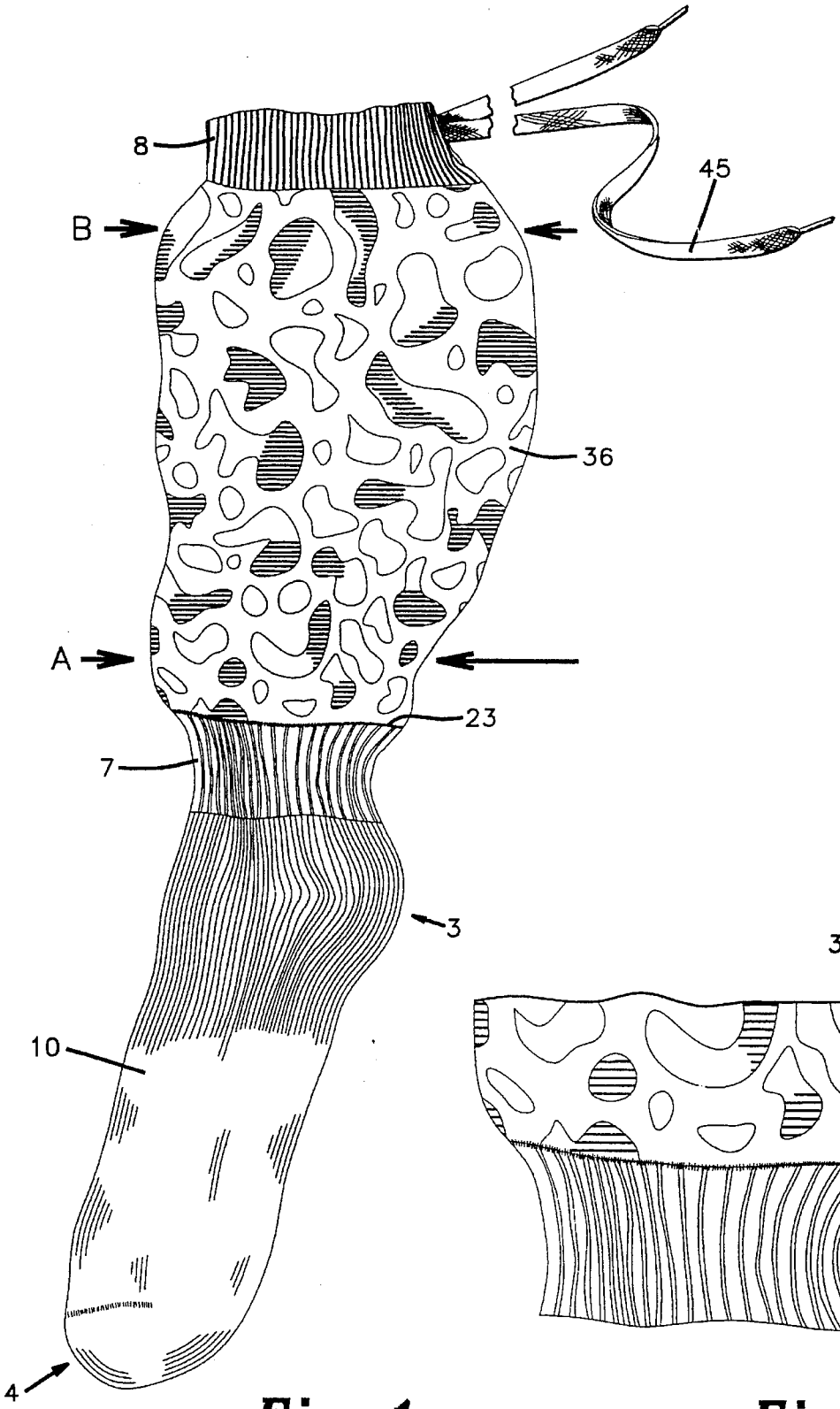
FIG. 1 shows a side view of the stocking according to the present invention, with the stocking oriented in the up or normal position.

3 heel closure area
4 toe closure area
7 lower cuff
8 upper cuff
10 circular knit foot portion
23 sewn joint
36 flat bed knit lower leg portion
45 lower leg drawstring
A bottom width
B top width

DETAILED DESCRIPTION OF THE INVENTION

Figure 2:
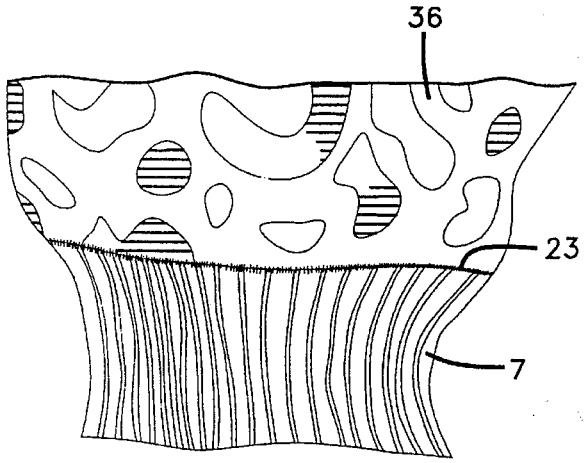
FIG. 2 shows a closer side view of the sewn joint between the lower leg portion and the foot portion of the stocking.

Referring to FIGS. 1 and 2, a preferred embodiment of the present invention is generally shown having a conventional circular knit foot portion 10 which incorporates a heel closure area 3 and a toe closure area 4 using conventional techniques. The circular knit foot portion 10 may be joined to a conventional lower cuff 7, which is also typically knitted using circular knitting, but may also be constructed using flat bed knitting techniques. Lower cuff 7 is in turn sewn to a lower leg portion 36, and joined thereto using sewn joint 23, as shown in FIG. 2.

Knitting techniques for the lower leg portion 36 may include well known and various tricot, raschel and milanese knitting methods, using techniques known in the art. The use of a flat knit lower leg portion 36 allows pattern differentiation as described above, where yarn type and color, needle patterns, and stitch types may be varied at will. With a substantial differential between top width B and bottom width A as shown on lower leg portion 36, a genuine taper is provided as contemplated above. A lengthwise seam, not shown, is provided for as taught in the art. If desired, lower leg portion 36 may be flat bed constructed using weft knits such as plain/jersey, rib, or purl knits.

A circular or flat bed knit upper cuff 8 is joined to lower leg portion 36 using various well known techniques. Upper cuff 8 serves to cap the design provided by lower leg portion 36 and to assist in holding the sock up on the leg. Alternatively, a lower leg drawstring 45 may be incorporated using known techniques into the upper cuff 8; or alternatively at the top section of lower leg portion 36, if an upper cuff 8 is not used; or alternatively still somewhere in the body of lower leg portion 36, perhaps running along its length.

Options for forming cuffs include traditional cuffs with no special interior pattern or lining; or "fold over" cuffs which show the exterior pattern or design for an inch or two on the inside of the sock. The use of a drawstring near the sock opening can provide support and sealing of the lower leg and foot from the cold or from snow, rain, dust, etc. Velcro® pockets or other features may also be added to the sock leg body, as is known in the art.

Also as known in the art, any number of linings or fold overs may be used to line the lower leg portion 36. This can allow for a different pattern, even a pattern reminiscent of a circular knit article, to be used inside the lower leg portion 36 against the wearer's leg. If a particular chosen exterior pattern used on lower leg portion 36 is scratchy or uneven, a lining cloth may be incorporated into its inside surface for comfort.

Any number of finishing processes may be employed without departing from the scope of the invention. In addition to conventional washing, drying, boarding, scouring, bleaching and dyeing, the fabric of the resulting stocking may undergo any number of enhancing or finishing treatments, such as: [1] napping or brushing, then shearing or singeing to produce a soft, velvety surface; [2] application of heat and pressure to improve luster (decating); [3] stretching processes like crabbing or tentering, which along with heat-setting serve to set the fabric to its final configuration and dimensions; [4] smoothing processes like calendering and pressing to improve luster and give a flat sheen; [5] special effects such as moireing and embossing; [6] modern treatments for softening, shrinkage control, "permanent press", "wash and wear" or antistatic characteristics; and [7] waterproofing and fireproofing methods. All these finishing steps and treatments are well known in the art, and one or more of them may be applied after using the teaching given here.

Obviously, many modifications and variations of the present invention are possible in light of the above teaching. It is therefore to be understood, that within the scope of the appended claims, the invention may be practiced otherwise than as specifically described or suggested here.

I claim:

1. An knitted stocking construction, comprising a circular knit tubular foot portion having an open and a closed bottom end; and a tapered flat bed knit lower leg portion having a top and bottom end, said bottom end joined to the open top end of said circular knit tubular foot portion the lower leg portion is formed with a continuous taper from the top to the bottom end thereby forming a self supporting lower leg portion.

2. The knitted stocking of claim 1, wherein a circular knit lower cuff is joined to said top end of said circular knit foot portion and also joined to said bottom end of said tapered flat bed knit lower leg portion.

3. The knitted stocking of claim 1, wherein a flat bed knit lower cuff is joined to said top end of said circular knit foot portion and also joined to said bottom end of said tapered flat bed knit lower leg portion.

4. The knitted stocking of claim 1, wherein a circular knit upper cuff is joined to said top end of said tapered flat bed knit lower leg portion.

5. The knitted stocking of claim 1, wherein a flat bed knit upper cuff is joined to said top end of said tapered flat bed knit lower leg portion.

6. The knitted stocking of claim 1, wherein said tapered flat bed knit lower leg portion is warp knitted.

7. The knitted stocking of claim 1, wherein said tapered flat bed knit lower leg portion is weft knitted.

8. The knitted stocking of claim 4, wherein said circular knit upper cuff incorporates a drawstring.

9. The knitted stocking of claim 5, wherein said flat bed knit upper cuff incorporates a drawstring.

* * * * *